US009108409B2

(12) United States Patent
Suzuki et al.

(10) Patent No.: US 9,108,409 B2
(45) Date of Patent: Aug. 18, 2015

(54) INKJET PRINTING APPARATUS AND METHOD OF CONTROLLING THE SAME

(75) Inventors: Kazuo Suzuki, Yokohama (JP); Kazuhiko Sato, Tokyo (JP); Taku Yokozawa, Yokohama (JP); Yosuke Ishii, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 641 days.

(21) Appl. No.: 12/787,905

(22) Filed: May 26, 2010

(65) Prior Publication Data

US 2010/0302297 A1 Dec. 2, 2010

(30) Foreign Application Priority Data

Jun. 2, 2009 (JP) ..... 2009-133355

(51) Int. Cl.
*B41J 2/165* (2006.01)
*B41J 29/38* (2006.01)

(52) U.S. Cl.
CPC ..... *B41J 2/16526* (2013.01); *B41J 2/16535* (2013.01); *B41J 29/38* (2013.01)

(58) Field of Classification Search
CPC ..... B41J 2/16535
See application file for complete search history.

(56) References Cited

U.S. PATENT DOCUMENTS

| | | | | |
|---|---|---|---|---|
| 5,311,214 | A | 5/1994 | Hirasawa et al. | |
| 5,483,266 | A * | 1/1996 | Nakamura | 347/23 |
| 6,196,655 | B1 | 3/2001 | Hirasawa et al. | |
| 7,052,107 | B2 | 5/2006 | Yamada et al. | |
| 7,396,098 | B2 | 7/2008 | Kanematsu et al. | |
| 7,517,044 | B2 | 4/2009 | Suzuki et al. | |
| 7,997,679 | B2 | 8/2011 | Yakura et al. | |
| 2002/0118247 | A1 * | 8/2002 | Fukasawa et al. | 347/29 |
| 2004/0233247 | A1 * | 11/2004 | Yamada et al. | 347/23 |
| 2006/0197799 | A1 * | 9/2006 | Sato et al. | 347/33 |
| 2009/0167802 | A1 | 7/2009 | Suzuki et al. | |

FOREIGN PATENT DOCUMENTS

| | | | |
|---|---|---|---|
| JP | 07-195708 | A | 8/1995 |
| JP | 2004-345290 | A | 12/2004 |
| WO | 2004-005034 | A1 | 1/2004 |

OTHER PUBLICATIONS

Office Action—Japanese Patent Appln. No. 2009-133355 mailed Apr. 23, 2013, Japanese Patent Office.

* cited by examiner

*Primary Examiner* — Uyen Chau N Le
*Assistant Examiner* — Chad Smith
(74) *Attorney, Agent, or Firm* — Fitzpatrick, Cella, Harper & Scinto

(57) ABSTRACT

The invention prevents inconveniences from being caused by ejection failure and unintended mixing of different colors. To this end, the invention performs preliminary ejection of ink after a wiping action to sweep mist adhering to a face of a printing head, in which an ejection opening is formed. Moreover, the amount of ink to be wastefully consumed by the preliminary ejection after the wiping is reduced. To this end, the number of preliminary ejections is regulated. The degree of adherence of mist to the ejection-opening-formed face depends on the amount of printing (the number of printed sheets, the number of ink ejections for printing, or the like). So, at the time of the preliminary ejection after the wiping, the number of ink ejections in the preliminary ejection is regulated in accordance with the amount of printing that has been done since the last wiping action.

18 Claims, 9 Drawing Sheets

| NUMBER OF EJECTIONS SINCE LAST WIPING ACTION | LESS THAN $2\times10^8$ | EQUAL TO OR LARGER THAN $2\times10^8$ |
|---|---|---|
| WIPING ACTION | NO | YES |

FIG.5A

| NUMBER OF PRINTED SHEETS SINCE LAST WIPING ACTION | ONE | TWO | THREE OR MORE |
|---|---|---|---|
| NUMBER OF PRELIMINARY-EJECTIONS AFTER WIPING ACTION | 200 | 600 | 1000 |

FIG.5B

| NUMBER OF EJECTIONS SINCE LAST WIPING ACTION | LESS THAN $4\times10^8$ | EQUAL TO OR LARGER THAN $4\times10^8$ LESS THAN $6\times10^8$ | EQUAL TO OR LARGER THAN $6\times10^8$ LESS THAN $8\times10^8$ | EQUAL TO OR LARGER THAN $8\times10^8$ LESS THAN $1\times10^9$ | EQUAL TO OR LARGER THAN $1\times10^9$ |
|---|---|---|---|---|---|
| NUMBER OF PRELIMINARY-EJECTIONS AFTER WIPING ACTION | 200 | 400 | 600 | 800 | 1000 |

FIG.5C

FIG.7A

| NUMBER OF EJECTIONS SINCE LAST WIPING ACTION | LESS THAN $1\times10^8$ | EQUAL TO OR LARGER THAN $1\times10^8$ |
|---|---|---|
| WIPING ACTION | NO | YES |

FIG.7B

| NUMBER OF EJECTIONS SINCE LAST WIPING ACTION | LESS THAN $2\times10^8$ | EQUAL TO OR LARGER THAN $2\times10^8$ LESS THAN $3\times10^8$ | EQUAL TO OR LARGER THAN $3\times10^8$ LESS THAN $4\times10^8$ | EQUAL TO OR LARGER THAN $4\times10^8$ LESS THAN $5\times10^8$ | EQUAL TO OR LARGER THAN $5\times10^8$ |
|---|---|---|---|---|---|
| NUMBER OF PRELIMINARY-EJECTIONS AFTER WIPING ACTION | 200 | 400 | 600 | 800 | 1000 |

FIG.7C

| COLOR | Y | PY | M | PM | C | PC |
|---|---|---|---|---|---|---|
| NUMBER OF EJECTIONS SINCE LAST WIPING ACTION | $1.5\times10^7$ | $6.3\times10^8$ | $1.2\times10^6$ | $2.3\times10^6$ | $2.7\times10^8$ | $4.1\times10^8$ |
| NUMBER OF PRELIMINARY-EJECTIONS AFTER WIPING ACTION | 200 | 1000 | 200 | 200 | 400 | 800 |

| COLOR | Bk | Gy | Pgy | R | G | B |
|---|---|---|---|---|---|---|
| NUMBER OF EJECTIONS SINCE LAST WIPING ACTION | $9.8\times10^6$ | $3.2\times10^8$ | $7.3\times10^8$ | $4.3\times10^6$ | $9.9\times10^7$ | $2.3\times10^8$ |
| NUMBER OF PRELIMINARY-EJECTIONS AFTER WIPING ACTION | 200 | 600 | 1000 | 200 | 200 | 400 |

| DISTANCE BETWEEN PRINTING HEADS AND PRINTING MEDIUM | COEFFICIENT IN ACCORDANCE WITH DISTANCE BETWEEN PRINTING HEADS AND PRINTING MEDIUM |
|---|---|
| LOWEST | 0.4 |
| SLIGHTLY LOWER | 0.6 |
| STANDARD | 0.8 |
| SLIGHTLY HIGHER | 1 |
| HIGHEST | 1.2 |

FIG.8A

| HUMIDITY | COEFFICIENT IN ACCORDANCE WITH USE ENVIRONMENT |
|---|---|
| ～30% | 1 |
| 30%～60% | 0.9 |
| 60%～ | 0.8 |

FIG.8B

FIG.9A
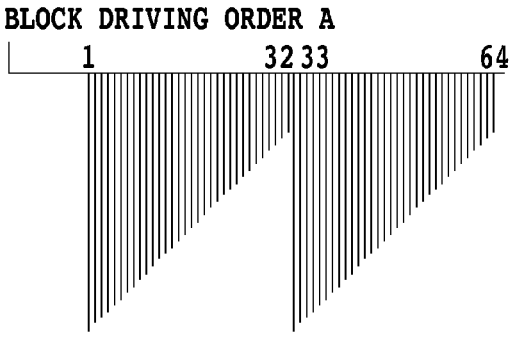
| NOZZLE NUMBER | 1 | 2 | 3 | 4 | 5 | 6 | 7 | 8 | … | 25 | 26 | 27 | 28 | 29 | 30 | 31 | 32 | 33 | 34 | 35 | 36 | 37 | 38 | 39 | 40 | … |
|---|---|---|---|---|---|---|---|---|---|---|---|---|---|---|---|---|---|---|---|---|---|---|---|---|---|---|
| DRIVING ORDER | 1 | 2 | 3 | 4 | 5 | 6 | 7 | 8 | … | 25 | 26 | 27 | 28 | 29 | 30 | 31 | 32 | 1 | 2 | 3 | 4 | 5 | 6 | 7 | 8 | … |
FIG.9B
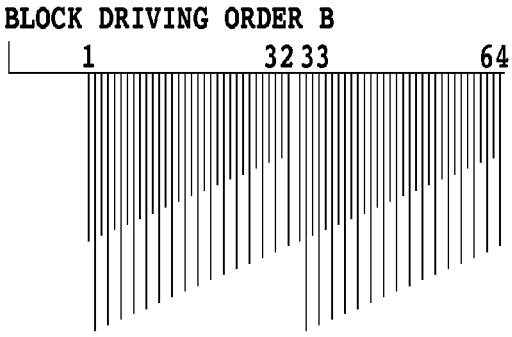
| NOZZLE NUMBER | 1 | 2 | 3 | 4 | 5 | 6 | 7 | 8 | … | 25 | 26 | 27 | 28 | 29 | 30 | 31 | 32 | 33 | 34 | 35 | 36 | 37 | 38 | 39 | 40 | … |
|---|---|---|---|---|---|---|---|---|---|---|---|---|---|---|---|---|---|---|---|---|---|---|---|---|---|---|
| DRIVING ORDER | 17 | 1 | 18 | 2 | 19 | 3 | 20 | 4 | … | 29 | 13 | 30 | 14 | 31 | 15 | 32 | 16 | 17 | 1 | 18 | 2 | 19 | 3 | 20 | 4 | … |
FIG.9C
| BLOCK DRIVING ORDER | BLOCK DRIVING ORDER COEFFICIENT |
|---|---|
| A | 0.3 |
| B | 1 |

INKJET PRINTING APPARATUS AND METHOD OF CONTROLLING THE SAME

BACKGROUND OF THE INVENTION

1. Field of the Invention

The invention relates to an inkjet printing apparatus that uses an inkjet head, and also to a method of controlling the inkjet printing apparatus. Specifically, the invention relates to a technique to effectively remove the mist that is produced when the inkjet head ejects ink.

2. Description of the Related Art

An inkjet head ejects ink directly onto a printing medium from a fine nozzle (hereafter sometimes referred to a unit including an ejection opening, a liquid passage that communicates with the ejection opening and an element to generate energy that is to be used for the ejection of ink). This way of ink ejection sometimes makes the ejected ink bounce off the printing medium, and also generates, in addition to the main mass of ink involved in the actual printing, fine ink droplets (satellites) that are ejected to float in the atmosphere. The bounced back portion of the ink and the floating satellites form ink mists, which sometimes adhere to the portion surrounding the ink-ejection opening of the inkjet head. The ink thus adhered to the surrounding portion of the ink-ejection opening may adversely affects the later action of ejecting ink. Failures of ejection may happen, or color mixture may occur because inks of different colors are mixed together. Consequently, the quality of an image to be printed on the printing medium may deteriorate.

A way of solving the problem is disclosed by Japanese Patent Laid-Open No. H07-195708 (1995). According to the disclosure, the adhered ink is removed by use of a wiping member made of an elastic material such as rubber. The surface of a printing head (hereafter, the surface will be referred to as "ejection face"), in which the ejection openings are formed, is wiped by the wiping member to remove the adhered ink (hereafter, the action of the wiping member will be referred to as "wiping action"). To carry out color printing, an inkjet head may have an array of plural nozzles to eject inks of plural colors. If this is the case, the wiping action may cause inks of different colors to be mixed together on the ejection face. If such color mixture occurs, it is highly possible that the quality of the printed image be unsatisfactory. To address this problem, the apparatus of Japanese Patent Laid-Open No. H07-195708 (1995) performs ejection to discharge inks of predetermined amounts after the wiping action (hereafter, such ejection will be referred to as "a preliminary ejection"), separately from the ejection of inks to actually print an image on a printing medium. While the preliminary ejection leads to an increase in the amount of inks to be wastefully discharged not for printing purpose, Japanese Patent Laid-Open No. H07-195708 (1995) also discloses a technique to suppress such increase due to the preliminary ejection. To this end, the apparatus regulates the number of times of the preliminary ejection on the basis of which kinds of inks have just been used for printing.

In recent years, there have been increasing demands for printing at a faster speed with a higher resolution as well as use of more colors for printing in inkjet printing apparatuses. Such trends lead to increases in the number of ejection openings formed in an inkjet head and in the number of ink colors. Such increases, in turn, tend to increase the amount of inks wastefully discharged in the preliminary ejection. This increase in the wasted inks has called for means of further reducing the wasteful consumption of inks. To this end, a more effective technique has been needed than the technique disclosed in Japanese Patent Laid-Open No. H07-195708 (1995).

SUMMARY OF THE INVENTION

Accordingly, an object of the invention is to prevent such inconveniences as ejection failure and color mixture from occurring by the preliminary ejection of inks performed after the wiping. A second object of the invention is to reduce the amount of inks consumed by the preliminary ejection of inks performed after the wiping, by regulating the amount of inks to be used in the preliminary ejection.

In an aspect of the present invention, there is provided an inkjet printing apparatus comprising:

a printing unit configured to printing medium by use of a printing head including an ejection portion in which an ejection opening to eject ink is formed;

a wiper for wiping a face of the printing head, the face having the ejection portion formed therein;

a preliminary-ejection unit performing preliminary ejection of ink from the ejection portion after the wiping by the wiper; and a regulation unit configured to regulate, in accordance with an amount of printing that has been made since the last wiping, an amount of ink to be ejected in the preliminary ejection.

In another aspect of the present invention, there is provided a method of controlling an inkjet printing apparatus to perform printing using a printing head including an ejection portion in which an ejection opening to eject ink is formed, the method comprising the steps of:

wiping a face of the printing head, the face having the ejection portion formed therein;

performing preliminary ejection of ink from the ejection portion after the wiping; and regulating, in accordance with an amount of printing that has been made since the last wiping, an amount of ink to be ejected in the preliminary ejection.

According to the invention, the preliminary ejection performed after the wiping can prevent such inconveniences as ejection failure and color mixture from occurring. In addition, the amount of inks used in the preliminary ejection is regulated in accordance with the degree of ink-mist adhesion to the ejection face. What is made possible consequently is a reduction in the amount of inks consumed in the preliminary ejection performed after the wiping.

Further features of the present invention will become apparent from the following description of exemplary embodiments (with reference to the attached drawings).

BRIEF DESCRIPTION OF THE DRAWINGS

FIG. 5A is a table to describe the conditions for starting the wiping action according to the first embodiment. FIG. 5B is a table to describe the conditions, applied to the first embodiment, for determining, in accordance with the number of the prints performed since the last wiping action, how many preliminary ejections should be carried out after the wiping of this time. FIG. 5C is a table to describe the conditions, applied to the first embodiment, for determining, in accordance with the number of the ink ejections for printing since the last wiping action, how many preliminary ejections should be carried out after the wiping of this time;

FIG. 7A is a table to describe the conditions for starting the wiping action according to the second embodiment. FIG. 7B is a table to describe the conditions, applied to the second embodiment, for determining, in accordance with the number of the ink ejections for printing since the last wiping action, how many preliminary ejections should be carried out for each of the colors after the wiping of this time. FIG. 7C is a table to describe the number of the ink ejections for printing for each of the colors since the last wiping action and the number, defined by the table of FIG. 7B, of preliminary ejections for each of the colors to be carried out after the wiping of this time;

FIG. 8A is a chart to describe the conditions, applied to a third embodiment, for determining, in accordance with the distance between the printing heads and the printing medium, how many preliminary ejections should be carried out after the wiping. FIG. 8B is a chart to describe the conditions, applied to the third embodiment, for determining, in accordance with the environment (humidity) in which the apparatus is used, how many preliminary ejections should be carried out after the wiping; and FIGS. 9A and 9B illustrate, respectively, examples of the orders in which blocks are driven according to a fourth embodiment. FIG. 9C is a chart to describe the conditions, applied to the fourth embodiment, for determining, in accordance with the block-driving order, how many preliminary ejections should be carried out after the wiping.

DESCRIPTION OF THE EMBODIMENTS

Figure 1:
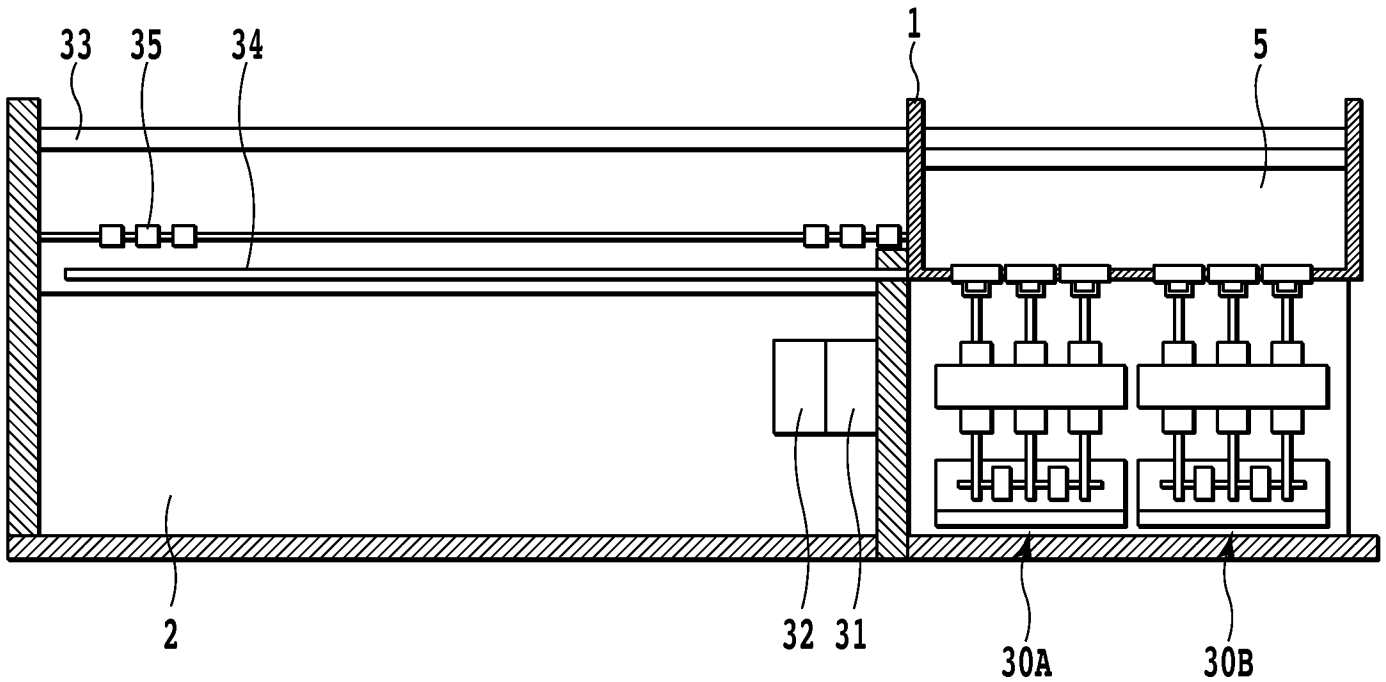
FIG. 1 is a schematic diagram illustrating an inkjet printing apparatus according to a first embodiment of the invention.

Some embodiments of the invention will be described in detail below by referring to the drawings.

First Embodiment

FIG. 1 is a schematic front view illustrating an inkjet printing apparatus according to a first embodiment of the invention.

FIG. 1 shows a main body 2 of the printing apparatus including a unit of conveying system. The printing apparatus is capable of printing on a relatively large printing medium such as A3-size sheet or larger. A carriage 1 is capable of moving with an inkjet head (hereafter, referred to as a "printing head") 5 that is mounted on the carriage 1. The printing head 5 includes, for example, six ejection portions (nozzle arrays) that correspond respectively to inks of six colors. A guide shaft 33 guides the carriage 1 when the carriage 1 moves. The carriage 1 is made to reciprocate along the guide shaft 33 by the driving force transmitted by means of a belt 34. With this mechanism, the printing head 5 can move relative to the printing medium. While moving relative to the printing medium, the printing head 5 ejects inks onto the printing medium to perform printing on the printing medium. The above-mentioned six colors of the inks to be used in the first embodiment are cyan (C), magenta (M), yellow (Y), black (Bk), photo cyan (PC), and photo magenta (PM). The inks of photo cyan (PM) and photo magenta (PM) are added to the other ordinarily-used four inks to reduce the granular impression of the printed image.

Recovery mechanisms 30A and 30B are mechanisms to maintain, or recover if necessary, the satisfactory ink-ejection performance of the ejection portions of the printing head 5. In the printing apparatus of the first embodiment, each of the recovery mechanisms 30A and 30B corresponds to three of the six ejection portions, and has caps to cover, respectively, the corresponding three ejection portions. When the printing head 5 is not used, the cap covers the corresponding ejection face (hereafter, a term "capping" will be used to mean the cap's action to cover the corresponding ejection face). By the capping action, the cap is capable of protecting the corresponding ejection portion, or the printing head 5. If an unillustrated pump is driven with the ejection faces capped with their respective caps, a sucking force acting on the ejection portions is generated so as to perform the action of "suction recovery", which is an action of forcing the inks to be discharged from their respective ejection openings. In addition, with the caps facing their respective ejection portions, the inks can be ejected into their respective caps to perform preliminary ejection. An ink-receptor box 31 is provided to receive inks ejected during the preliminary ejection. A wiping mechanism 32 is provided to carry out the action to wipe the ejection faces of the printing head 5.

In the printing apparatus with the above-described configuration, a printing medium is set at a printing position in accordance with the data on which the printing is carried out. With the printing medium set at the proper printing position, the carriage 1 is controlled so as to move along the guide shaft 33. While the printing head 5 is moving together with the carriage 1, the color inks are ejected from their respective ejection portions. Consequently, a single band of an image which includes letters, pictures, or the like of (a band is a printable area during a single action of moving the printing head 5) is printed on the printing medium. Once the printing for the single band is finished, the printing medium is conveyed, by an unillustrated conveyor unit, in a direction intersecting the moving direction of the carriage 1 by a predetermined distance (i.e., a width of a single band, or a distance corresponding to the width printed by a predetermined number of printing elements). Alternatively, if the inkjet printing apparatus performs printing by what is known as the "multipass printing" method (a method of printing an image for a single printing area by moving the printing head 5 plural times), the distance by which the printing medium is conveyed by a single conveying action may be smaller than the above-mentioned predetermined distance.

Encoders 35 are provided along the route that the carriage 1 is moving along. The encoders 35 are used for detecting the position where the moving carriage 1 is currently positioned. To know the current position of the carriage 1, the carriage 1 includes a built-in encoder sensor. When the encoder sensor detects the encoder 35, the encoder sensor sends a signal indicating the detected the encoder 35. The movement of the carriage 1 to its home position is controlled in accordance with the results of detection, carried out using the encoders 35, of the current position of the carriage 1. The recovery mechanisms 30A and 30B, the wiping mechanism 32, and the like are provided near the home position of the carriage 1.

Figure 2:
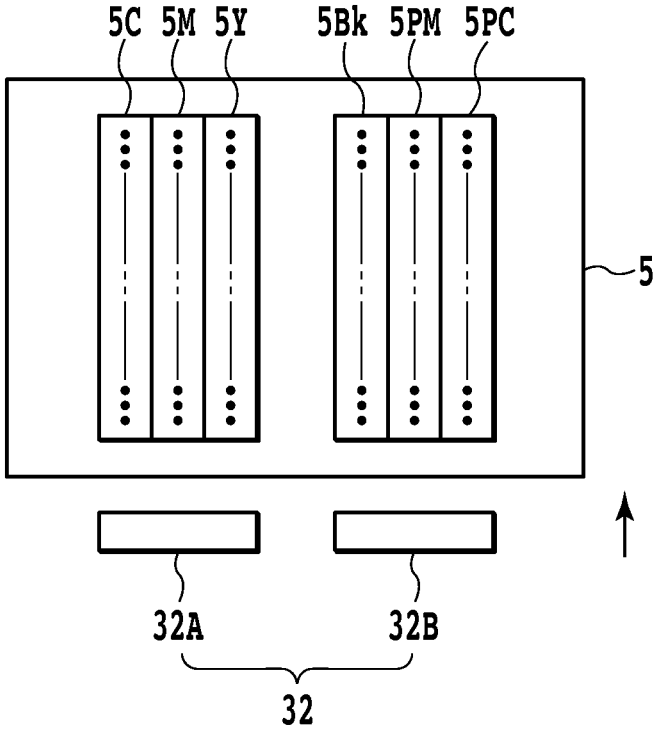
FIG. 2 is a schematic diagram to describe the configuration of a printing head and the configuration of a wiping mechanism according to the first embodiment, and to describe also the relationship between the printing head and the wiping mechanism.

FIG. 2 is a schematic diagram to describe the configuration of the printing head 5 and the configurations of the wiping mechanism 32. FIG. 2 also shows the relationship between the printing head 5 and the wiping mechanism 32. The printing head 5 includes ejection portions 5C, 5M, 5Y, 58*k*, 5PC, and 5PM that correspond respectively to the inks of cyan, magenta, yellow, black, photo cyan, and photo magenta. Each ejection portion includes an array of 1280 ejection openings that are arranged in a density of 1200 dpi (dots per inch) in a direction (the up-and-down direction in FIG. 2) intersecting the direction of moving the carriage 1 or the printing head 5 (right-and-left direction in FIG. 2). In each of the ink liquid passages communicating respectively with the ejection openings, an electrothermal transducer is provided to heat locally the ink in the passage so as to cause film boiling. The pressure generated by the film boiling is used to eject the ink.

In the first embodiment, the wiping mechanism 32 includes a wiper 32A and a wiper 32B. The wiper 32A is capable of wiping the ejection faces of the ejection portions 5C, 5M, and 5Y. The wiper 32B is capable of wiping the ejection faces of the ejection portions 5Bk, 5PC, and 5PM. To carry out the wiping, the wipers 32A and 32B are moved in the direction indicated by the arrow in FIG. 2 with the printing head 5 set at a position corresponding to the wiping mechanism 32.

Figure 3:
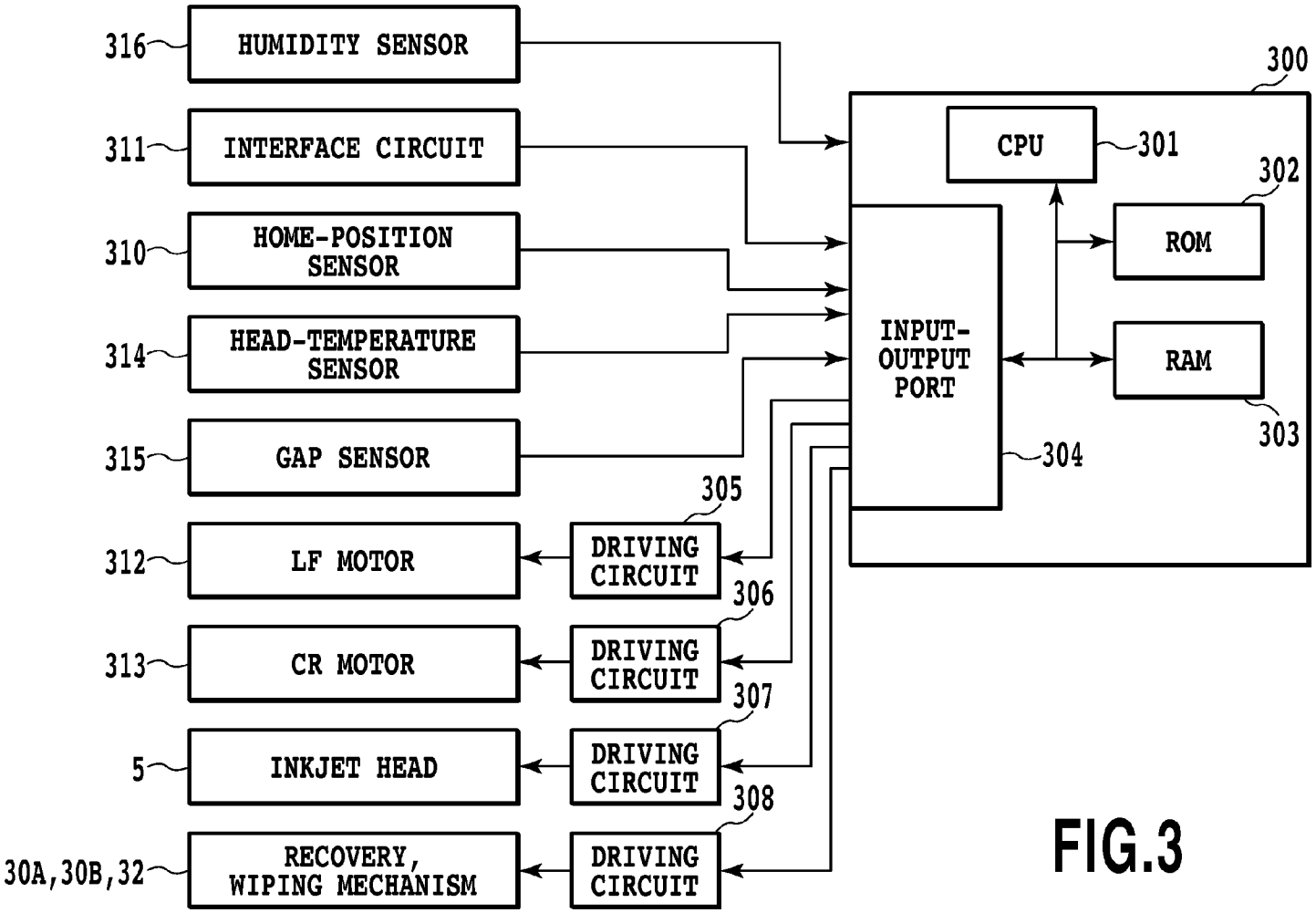
FIG. 3 is a block diagram illustrating an exemplar configuration of a control system of the printing apparatus according to the first embodiment.

FIG. 3 is a block diagram illustrating an exemplar configuration of the control system for the printing apparatus according to the first embodiment. In the first embodiment, the reference numeral 300 in FIG. 3 denotes a main controller serving as the preliminary ejection unit capable of performing the preliminary ejection of the inks from their respective ejection portions after the wiping action by the wipers 32A and 32B and also as a controller unit to regulate, in accordance with the amount of prints done after the last wiping, the amount of inks to be used in the preliminary ejections. The main controller 300 includes a CPU 301, a ROM 302, a RAM 303, an input-output port 304, and the like. The CPU 301 executes the necessary processing actions such as calculations, controls, determinations, and settings. The CPU 301 also executes a series of processes shown in FIG. 4, which will be described in detail later. The ROM 302 stores the control program that the CPU 301 should execute. The ROM 302 also stores other fixed data. Specifically, the ROM 302 stores a program corresponding to the above-mentioned series of processes shown in FIG. 4, and tables shown in FIGS. 5A and 5B or 5C, which will be described in detail later. The RAM 303 includes a buffer area for the data that the printing to be carried out is based upon, and an area to be used as a work area in the course of the execution, by the CPU 301, of various processings. Specifically, the RAM may include an area to be used as a counter to count the amount of printing that is used in the processes to be described later. This amount of printing may includes the number of the printed media, or the number of ink ejections for printing.

The input-output port 304 is connected to the that driving circuits 305 and 306. The driving circuit 305 drives a conveyor motor (LF motor) 312 that serves as the source of driving force provided to the conveyor system. The driving circuit 306 drives a motor (CR motor) 313 that serves as the source of driving force to move the carriage 1. In addition, the input-output port 304 is connected to the driving circuits 307 and 309. The driving circuit 307 drives the nozzles of the ejection portions of the printing head 5. The driving circuit 309 drives the recovery mechanisms 30A and 30B, and the wiping mechanism 32.

In addition, the input-output port 304 is connected to a home-position sensor 310, a head-temperature sensor 314, a gap sensor 315, and an interface circuit 311. The home-position sensor 310 detects the position that serves as the reference for the control on the movement of the carriage 1 or the printing head 5. In addition, the home-position sensor 310 outputs its detection results that are used when the printing head 5 is set at a position where the recovery mechanisms 30A and 30B, and the wiping mechanism 32 carry out their tasks on the printing head 5. The head temperature sensor 314 detects the temperature of the printing head 5. The gap sensor 315 detects the distance (gap) between the printing head 5 and the printing medium or the platen supporting the printing medium. The interface circuit 311 is used to receive/transmit necessary data from/to an external device (the external device may be provided in an appropriate form, such as a computer, an image scanner, a digital camera, or the like) serving as the source to supply data that the printing to be performed is based upon. A humidity sensor 316 is provided at an appropriate position. The humidity sensor 316 detects humidity that forms a part of the environment under which the printing apparatus is used. Note that the gap sensor 315 and the humidity sensor 316 are elements that are preferably provided in a third embodiment to be described later.

Figure 4:
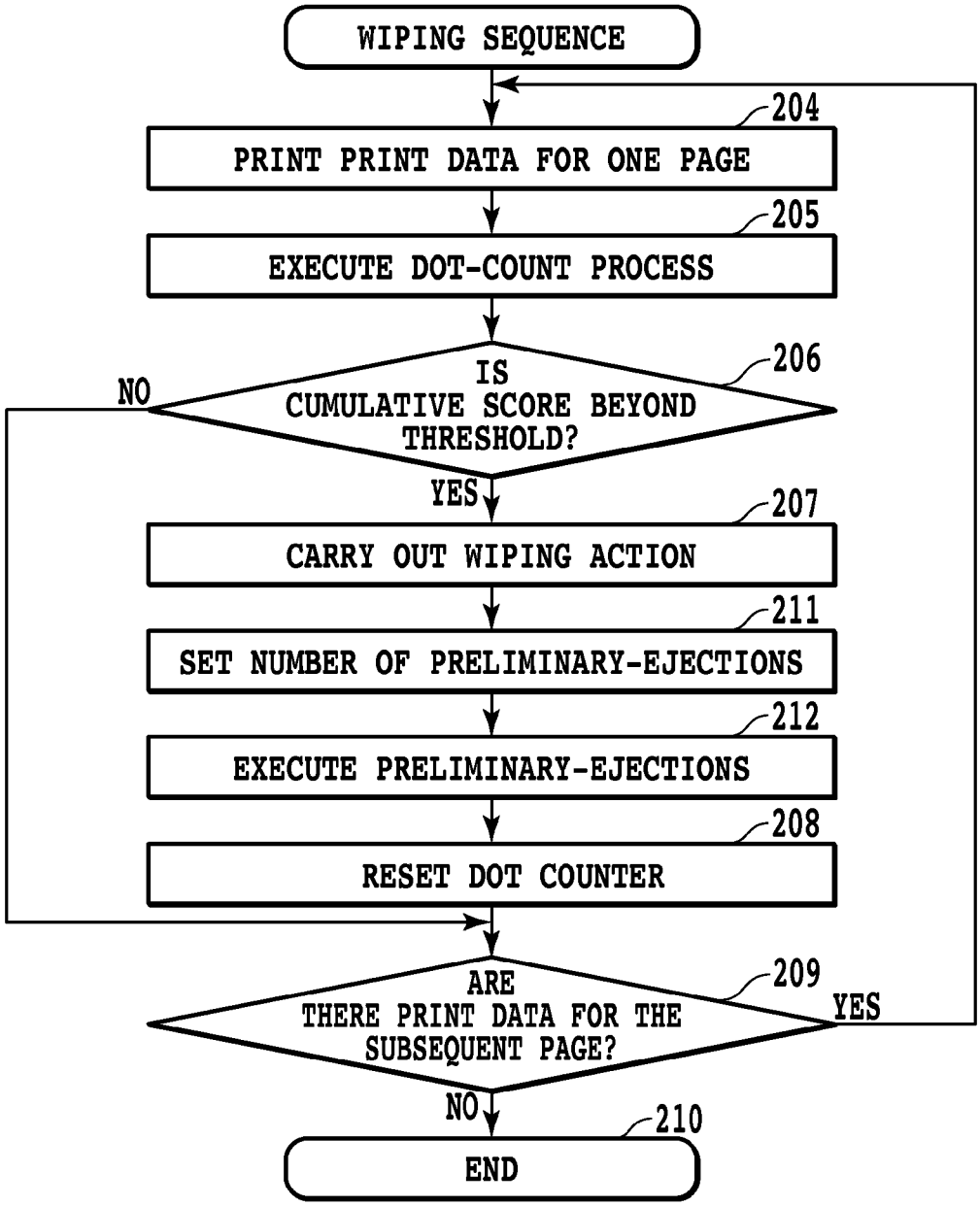
FIG. 4 is a flowchart illustrating the control procedure to carry out a wiping action and subsequent preliminary ejection according to the first embodiment.

FIG. 4 illustrates a series of control processes to carry out the wiping action and the subsequent preliminary ejection according to the first embodiment.

When a wiping action is carried out every time a predetermined unit of prints, e.g., printing on a sheet of printing medium (printing for one page) is finished, the wiping action interposed as such, however, causes various problems. For example, every time the wiping action is carried out, it takes a certain length of time resulting in a lower productivity in the printing. In addition, wiping actions carried out too frequently may shorten the service life of the wipers 32A and 32B. Accordingly, the wiping action should be carried out on a necessary basis. Whether a wiping action is or is not necessary for each page is preferably determined on a basis of the quantity of mist that can adhere to the ejection faces of the printing head 5. The quantity of the mist adhering to the ejection faces of the printing head 5 depends heavily on the amount of ejected inks, or on the number of ink ejections. Accordingly, in the first embodiment, the number of ink ejections for printing performed since the last wiping action is counted (i.e., a dot count is performed). If the counted number of ink ejections reaches a threshold, a wiping action will be carried out.

In the series of processes shown in FIG. 4, the printing of print data for one page is performed at step S204. Then, a dot-count process is executed at step S205 to accumulate the number of ink ejections that have been performed in accordance with the print data. Then at step S206, whether the cumulative number of the dot count is or is not beyond a threshold is determined on a basis of a table such as one shown in FIG. 5A. If the determination is affirmative, a wiping action is carried out at step S207, and the dot counter is reset at step S208. In addition, an appropriate number of preliminary ejections (i.e., actions of ejecting inks that are not actually involved in printing) to be carried out after the wiping action is set at step S211. Then, at step S212, preliminary ejections are carried out the number of times thus set at step S211. Once the set number of preliminary ejections are finished, or if the determination at step s206 is negative, a determination of step S209 is carried out to determine whether there are or are not print data for the subsequent page. If this determination is affirmative, the process of step 204 is executed once again to carry out the printing of the subsequent one page. If there are no more print data, the series of processes shown in FIG. 4 is terminated at step S210.

It is a known fact that preliminary ejection of inks of a certain amount is preferably carried out every time a wiping action is performed. There are two main reasons for this. Firstly, it is often the case that the mist that adheres to the ejection faces before the wiping increases its viscosity due to evaporation of the solvent component of inks caused by various reasons. For example, the ejection of inks itself causes the evaporation of the solvent component of inks. The airflow caused by the moving carriage 1 also causes the evaporation of the solvent component of inks, and the heat generated around the printing head 5 also causes the evaporation of the solvent component of inks. If such adhered inks with increased viscosity are wiped with the wipers 32A and 32B, the inks with increased viscosity may be forced into the nozzles to clog the nozzles. If such clogging occurs and an ink ejection action for the primary purpose, i.e., action of ejecting inks for actual printing, is carried out for the next time with no preliminary ejection having been performed beforehand, ejection failure may take place. The second one of the above-mentioned two main reasons is related to the mixing of inks of different colors. In the first embodiment, the printing head 5 has a structure with plural ejection portions provided respectively for the plural inks of different colors, and each of the wipers 32A and 32B is assigned to wipe the ejection faces of the corresponding plural inks of different colors. In the case of the first embodiment or the like cases, performing wiping actions may force the ink of one color adhered to its own ejection face into nozzles for the inks of different colors. If this occurs, an action of ejecting inks for the primary purpose (i.e., for actual printing) with no preceding preliminary ejection may cause the mixing of different colors. So, such inconveniences as the above-mentioned ejection failure and the mixing of inks of different colors can be avoided by carrying out preliminary ejection to discharge the inks with increased viscosity or the inks of different colors that have been forced into the nozzles.

Accordingly, some of the conventional inkjet printing apparatuses have carried out preliminary ejection of inks of a predetermined amount after every wiping action. In the first embodiment of the invention, however, the inkjet printing apparatus controls the amount of inks used for the preliminary ejection, or, to be more specific, the number of ink ejections in each occasion of preliminary ejection. The control of this first embodiment is based on the quantity of printing, which affects the degree of adherence of mist to the printing head.

Specifically, the number of preliminary ejections after each wiping action can be controlled, for example, in accordance with the count value obtained by counting the number of sheets that have been printed since the last wiping action. If many sheets have been printed since the last wiping action, a larger amount of mist is likely to have adhered to the ejection faces. In this case, a wiping action is more likely to force more inks with increased viscosity into the nozzles and/or to force more inks into nozzles of different colors. So, the number of preliminary ejections is increased. In contrast, if sheets that have been printed since the last wiping action are not many, a smaller amount of mist is likely to have adhered to the ejection faces. In this case, a wiping action may have forced a smaller amount of inks with increased viscosity into the nozzles and/or may have forced a smaller amount of inks into nozzles of different colors. So, the number of preliminary ejections is decreased.

As has been described thus far, by carrying out preliminary ejection after wiping, the inkjet printing apparatus of this first embodiment can prevent the degradation of printing quality from being caused by the ejection failures and the unintended mixing of inks of different colors. In addition, in accordance with the degree of adherence of mist to the ejection faces of the printing head 5, the inkjet printing apparatus of this first embodiment controls the number of preliminary ejections to be carried out after each wiping action. So, the amount of inks wastefully consumed for the preliminary ejection after the wiping can be reduced. Such reduction can contribute to a reduction of the running cost for the inkjet printing apparatus. Note that, if the control on the preliminary ejections after the wiping is based on the number of printed sheets as in the above-described case, the count value for the printed sheets is to be reset. In addition, the purpose of this first embodiment can be achieved by adjusting, in accordance with the quantity of prints, the amount of inks to be used in the preliminary ejection performed after the wiping. So, the purpose is achieved also by adjusting amount of ink to be ejected in each preliminary ejection action (i.e., the amount of ink of a single droplet).

In addition, a more finely-tuned control may be carried out. For example, as FIG. 5C shows, a dot count (the counting of ink ejections for actual printing) since the last wiping action is carried out. Then, in accordance with the count value, the number of preliminary ejections to be performed after the wiping of this time is controlled. With a larger value of the dot count, a larger number of preliminary ejections are to be performed. In contrast, with a smaller value of the dot count, a smaller number of preliminary ejections are to be performed. To perform the control in this way, a process of setting the number of preliminary ejections (step S211 in FIG. 9) and a process of carrying out the set number of preliminary ejections (step S212) are executed between step S207 and step S208 in FIG. 4.

Second Embodiment

In this second embodiment, a more finely-tuned control on the number of the preliminary ejections to be performed after each wiping action is executed so as to obtain a larger effect than in the case of the first embodiment. The second embodiment is particularly effective if inks of a larger number of different colors are used.

The inks to be used in the second embodiment are cyan (C), magenta (M), yellow (Y), photo cyan (PC), photo magenta (PM), photo yellow (PY), black (Bk), gray (Gy), photo gray (Pgy), Red (R), green (G), and blue (B).

Figure 6:
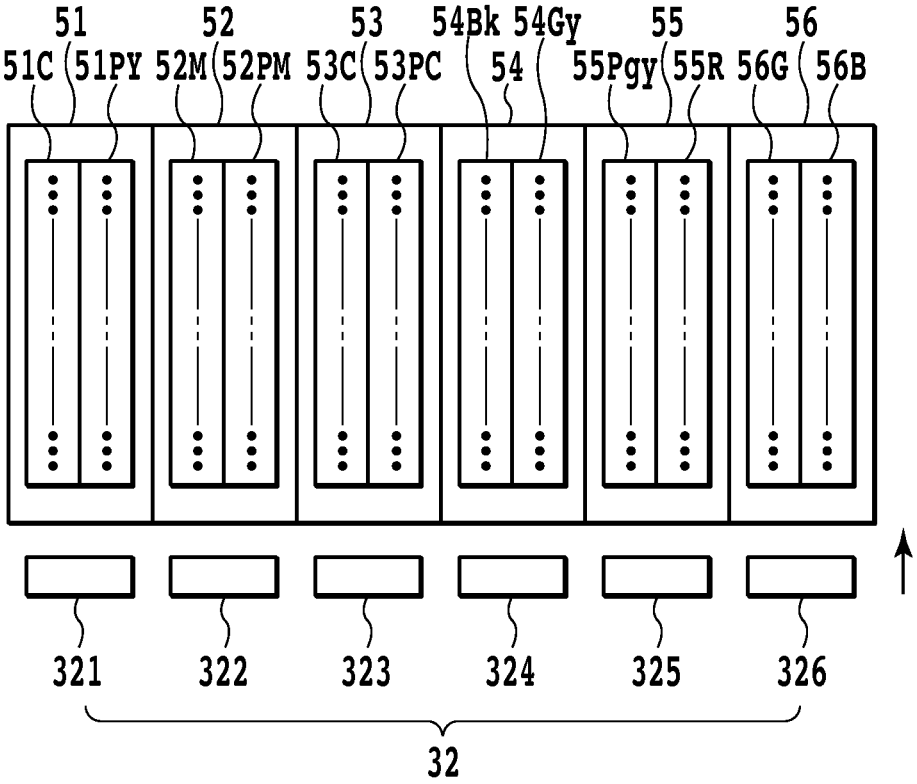
FIG. 6 is a schematic diagram to describe the configuration of printing heads and the configuration of a wiping mechanism according to a second embodiment, and to describe also the relationship between the printing heads and the wiping mechanism.

FIG. 6 is a schematic diagram to describe the configuration of printing heads and the configuration of the wiping mechanism according to the second embodiment. FIG. 6 also shows the relationship between the printing heads and the wiping mechanism. For the purpose of handling the inks of the twelve different colors, six printing heads each including two ejection portions are provided in this second embodiment. A printing head 51 includes an ejection portion 51Y corresponding to the ink of yellow and an ejection portion 51PY corresponding to the ink of photo yellow. A printing head 52 includes an ejection portion 52M corresponding to the ink of magenta and an ejection portion 52PM corresponding to the ink of photo magenta. A printing head 53 includes an ejection portion 53C corresponding to the ink of cyan and an ejection portion 53PC corresponding to the ink of photo cyan. A printing head 54 includes an ejection portion 54Bk corresponding to the ink of black and an ejection portion 54Gy corresponding to the ink of gray. A printing head 55 includes an ejection portion 55Pgy corresponding to the ink of photo gray and an ejection portion 55R corresponding to the ink of red. A printing head 56 includes an ejection portion 56G corresponding to the ink of green and an ejection portion 56B corresponding to the ink of blue. Tn each of the ejection portions, ejection openings are arrayed in the same direction and in the same density as their respective counterparts in the first embodiment.

A wiping mechanism 32 includes wipers 321 to 326. The wipers 321 to 326 are driven to move in the direction indicated by the arrow in FIG. 6 to wipe the ejection faces of the printing heads 51 to 56, respectively. These six wipers 321 to 326 may be individually driven, but, in this second embodiment, all of these wipers 321 to 326 are formed into a unit and are thus driven simultaneously. This configuration of wipers 321 to 326 in this second embodiment are designed for the purposes of making the driving control simpler, and of making the apparatus smaller in size and producible at lower costs.

The configuration of the control system and the series of control processes of this second embodiment may be the ones that are similar to their respective counterparts in the first embodiment. In this second embodiment, however, whether a wiping action should or should not be performed and how many preliminary ejections should be performed are determined in the following way.

FIG. 7A is an exemplar table used to determine whether a wiping action should or should not be performed. The dots that have been ejected since the last wiping action are counted for each color. According to the table shown in FIG. 7A, if there is a dot-count value that is equal to or larger than a threshold, a wiping action will be carried out. FIG. 7B is an exemplar table used to set the number of preliminary ejections to be performed after the wiping. According to the table shown in FIG. 7B, the number of preliminary ejections for each of the twelve colors is determined in accordance with the number of dots which have been ejected after the last wiping action. Note that the above-mentioned number of dots is counted individually for each of the twelve colors.

Inks of many colors are used in this second embodiment. So, a more finely-tuned control on the number of preliminary ejections is executed. Specifically, if the number of dots for one color that have been ejected since the last wiping action differs from the corresponding number for another color, the numbers of preliminary ejections to be performed for the these colors may be different from each other. Such arrangement aims to improve the following points in the first embodiment.

When the number of preliminary ejections to be performed after the wiping is set, the following point should be taken into consideration. Assuming that the largest possible amount of mist adheres to the printing heads, the preliminary ejections of the set number must eliminate the possibilities of ejection failure and of the unintended mixing of different colors caused by the wiping action which forces the inks with increased viscosity into nozzles and which forces the inks of individual colors into wrong nozzles. According to the table shown in FIG. 7B, the maximum number of preliminary ejections is set at a thousand. This setting of the maximum number of preliminary ejections is relevant not only to the second embodiment but also to the first embodiment.

In the first embodiment, however, the 1000 preliminary ejections are set equally for the ejection portions for the inks of all the colors even if only the ink of, for example, yellow has been used to print all the image. If this way of setting the number of preliminary ejections is adopted in this second embodiment, a total of 15360000 preliminary ejections, 15360000=1000 (number of preliminary ejections for each color)×12 (number of colors)×1280 (number of nozzles for each color), must be performed after the wiping of this time irrespective of the image pattern that has been printed.

In the printing of the images that exclusively use the ink of, for example, yellow, the printing heads 52 to 56 eject no inks for printing. Accordingly, little, if any, mist probably adheres to the ejection faces of these printing heads 52 to 56. So, there will be no problem even if a smaller number of preliminary ejections are set for each of the printing heads 52 to 56. For this reason, the apparatus of the second embodiment counts, individually for each color, the dots that have been ejected for printing since the last wiping action. Then, by referring to the table shown in FIG. 7B, the number of preliminary ejections to be performed is regulated individually for the ink of each color. In the case of images printed exclusively with the ink of yellow, the total number of preliminary ejections is as small as 4096000 (=1000 (number of preliminary ejections for each color)×1 (number of colors)×1280 (number of nozzles for each color)+200 (number of preliminary ejections for each color)×11 (number of colors)×1280 (number of nozzles for each color)). The 409600 preliminary ejections are approximately 73% smaller than the above-mentioned 15360000 preliminary ejections.

FIG. 7C shows, individually for each of the twelve colors, an exemplar number of dots that have been ejected for printing since the last wiping action. FIG. 7C also shows the number of preliminary ejections for each color obtained on the basis of the above-mentioned number of dots and by referring to the table shown in FIG. 7B. In this case, the total number of preliminary ejections is obtained by multiplying the sum of the numbers listed in the lowest cells by the number of nozzles for each color. Specifically, the total number of preliminary ejections in this case is 6980000, which is approximately 58% smaller than the above-mentioned 15360000 preliminary ejections.

As has been described thus far, by carrying out preliminary ejection after wiping, the inkjet printing apparatus of this second embodiment can prevent the degradation of printing quality from being caused by the ejection failures and the unintended mixing of inks of different colors. In addition, the inkjet printing apparatus of this second embodiment performs a more finely-tuned control on the number of preliminary ejections to be carried out after the wiping of this time. So, a larger effect of reducing the amount of inks wastefully consumed for the preliminary ejection can be obtained.

In this second embodiment, the counting of dots that have been ejected since the last wiping action is performed for each of the colors (for each of the ejection portions), and the number of preliminary ejections after the wiping action is regulated for each of the colors (for each of the ejection portions). It is, however, possible to count the dots for each of the printing heads, and to regulate the number of preliminary ejections for each of the ejection portions.

Third Embodiment

A third embodiment of the invention is a case where the number of preliminary ejections after wiping is regulated by taking account of the degree of adherence of mist to the ejection faces and which is affected by factors other than the number of ejected dots.

The regulation of the number of preliminary ejections for each printing head in this third embodiment is more finely-tuned than the regulation in the second embodiment. To this end, the regulation, performed in the second embodiment, of the number of preliminary ejections for each printing head shown in FIG. 7B is refined by taking account of the possibility of adherence of mist to the printing heads affected by 'the distance between the printing heads and the printing medium' and 'the environment in which the printing apparatus is used'. Here, the distance (gap) between the printing head 5 and the platen detected by the gap sensor 315 is defined as 'the distance between the printing heads and the printing medium', regardless of the thickness of the printing medium.

However, it may be possible to precisely define 'the distance between the printing heads and the printing medium' by taking the thickness of the printing medium into consideration, based on additional data (including information on a kind of the printing medium) with an image data received from the external or host apparatus. Specifically, the number of preliminary ejections in this third embodiment is calculated by the following formula.

(The number of preliminary ejections after the wiping)=(The number of preliminary ejections shown in FIG. 7B)×(A coefficient determined in accordance with the distance between the printing heads and the printing medium)×(A coefficient determined in accordance with the environment in which the printing apparatus is used)

FIG. 8A is a table showing the distance between the printing heads and the printing medium, and the coefficient determined in accordance with the above-mentioned distance. FIG. 8B is a table showing the environment in which the printing apparatus is used and the coefficient determined in accordance with the above-mentioned environment. Detailed description of each of the tables will be given below.

Some inkjet printing apparatuses are equipped with a mechanism for lifting carriage (such a mechanism is illustrated in none of the accompanying drawings). An inkjet printing apparatus equipped with such a carriage lifting mechanism is capable of changing the distance between the printing heads and the printing medium. For example, on the basis of the kind of printing medium to be used or of the environmental conditions, or simply by the user's choice, the distance (i.e., the level of the printing heads) can be switched among the following five positions: 'lowest,' 'slightly lower,' 'standard,' 'slightly higher,' 'highest.'

It is a known fact that the larger the distance between the printing heads and the printing medium is, the larger the amount of mist adhering to the printing heads or to the ejection faces tends to be. Such tendency is due to the following reason. As the distance between the printing heads and the printing medium is larger, the particles of the mist such as satellites each of which has a smaller mass or which fly at slower speeds cannot reach the surface of the printing medium. Instead, such particles float within the printing apparatus and eventually adhere to the ejection faces. So, in this third embodiment, the gap sensor 315 is used to detect the distance between the printing heads and the printing medium, and a coefficient (such as ones listed in FIG. 8A) is determined in accordance with the detected distance. Then, the number of preliminary ejections after the wiping is adjusted by multiplying the coefficient.

In addition, it is also a known fact that the amount of mist adherence varies depending upon the environment in which the printing apparatus is used. To be more specific, the lower the humidity is, the larger the amount of the mist adherence tends to be. Such tendency is due to the following reason. As the humidity becomes lower, the evaporation of the ejected ink is encouraged. Consequently, the mass of each particle of the mist becomes smaller, or the particles of the mist fly at slower speeds. As described above, such particles of the mist cannot reach the surface of the printing medium. Instead, the particles of mist float within the printing apparatus, and are likely to eventually adhere to the ejection faces. So, in this third embodiment, a humidity sensor 316 (see FIG. 3) is used to detect the humidity, and a coefficient (such as ones listed in FIG. 8B) is determined in accordance with the detected humidity. Then, the number of preliminary ejections after the wiping is adjusted by multiplying the coefficient.

As has been described thus far, in the third embodiment, the number of preliminary ejections after the wiping is regulated by taking account of the possibility that the mist is made to adhere to the printing heads by factors other than the number of ejected dots. Specifically, such other factors that are taken into consideration are 'the distance between the printing heads and the printing medium' and 'the environment in which the printing apparatus is used (e.g., humidity, in particular)'. Accordingly, similar effects to those obtainable by the first and the second embodiments can be obtained in this third embodiment. In addition, a still larger effect of reducing the amount of inks wastefully consumed for the preliminary ejection can be obtained.

In this third embodiment, the number of preliminary ejections after the wiping is regulated by taking account of both 'the distance between the printing heads and the printing medium' and 'the environment in which the printing apparatus is used.' Alternatively, only either one of the above-mentioned two factors other than the number of ejected dots may be taken into consideration for the purpose of the regulation. Still alternatively, any factor other than the ones mentioned above may also be taken into consideration. In addition, humidity is not the only environmental condition. Such other conditions as the temperature or the air pressure may be taken into consideration as environmental conditions.

Fourth Embodiment

A method of driving a printing head is known as the block driving method. According to this driving method, all the nozzles provided in each ejection portion are not driven at a single timing. Instead, the nozzles are divided into plural blocks each of which has a predetermined number of nozzles, and the blocks of nozzles are driven in a time-division manner, that is, one block after another in a predetermined order. Such construction is particularly advantageous for the following reason. The number of nozzles included in each ejection portion has become larger and larger. Under the circumstances, there is a demand for a reduction in the electric power needed at a single driving timing. The time-division driving is an answer to the demand.

With a certain configuration of printing heads or of ejection portions, the order of driving the blocks may affect the image quality and the adherence of mist. Accordingly, in this fourth embodiment, two different block-driving orders are used respectively for occasions of different printing modes. In addition, the number of preliminary ejections is regulated by taking the block-driving orders into consideration.

Firstly, the block driving in this fourth embodiment will be described. In the fourth embodiment, the 1280 nozzles included in a single ejection portion are divided into 32 blocks each of which has 40 nozzles. Then, the blocks of nozzles are driven in a time-division manner one block after another. Note that each 'block' does not include spatially successive nozzles. Instead, each one of the nozzles included in each block is spatially separated from the next one by 31 nozzles. Specifically, counted from an end of the nozzle array, the 1st one, the 33rd one, the 65th one, . . . , and the 1249th one are included in a single block and are driven simultaneously. Then, as FIGS. 9A and 9*b* show, a block driving order A is used for printing in a mode principally targeting the printing of images for posters, photos, or the like (the mode will be simply referred to as the "poster-photo mode") whereas a block driving order B is used for printing in a "line-image mode" targeting principally the printing of line images such as CAD drawings.

When the 1st to the 32nd nozzles are driven in 'the block driving order A', each nozzle is driven after the previous one in the order of arrangement. Specifically, the 1st nozzle is driven first, and subsequently the 2nd nozzle is driven, . . . , and finally the 32nd nozzle is driven. The 33rd to the 64th nozzles are driven in a similar manner, that is, each nozzle is driven after the previous one in the order of arrangement. In this case, there is a large lag (difference in time) between the timing of driving the 32nd nozzle and the timing of driving the 33rd nozzle. The large time lag may cause the ink droplets to land at misaligned positions. The inventors found the fact that the amount of mist adherence in this case with the block driving order AI, however, is smaller than that in the case with 'the block driving order B'.

In contrast, when the 1st to the 32nd nozzles are driven in 'the block driving order B', the nozzles are driven one after another in a discrete order. The 33rd to the 64th nozzles are driven in a similar manner, that is, the nozzles are driven one after another in a similar discrete order. In this case with 'the block driving order B', the time lag between the driving of the 32nd nozzle and the driving of the 33rd nozzle is smaller than in the case with 'the block driving order A'. The inventors found the fact that the amount of mist adherence in this case with 'the block driving order B', however, is larger than that in the case with 'the block driving order A'.

The difference in the amount of mist adherence between cases with different block driving orders is probably caused by the following reason. In the case with 'the block driving order A', the pressure in one nozzle is made to fluctuate by the action of ink ejection by the driven, adjacent nozzle. The fluctuation of pressure destabilizes the meniscus immediately before the nozzle ejects ink. The unstable meniscus slows down the speed of ink ejected from the nozzle, so that fewer satellites are produced. Consequently, the amount of mist adhering to the ejection faces is probably reduced. In contrast, in the case with 'the block driving order B', the meniscus in one nozzle immediately before the nozzle ejects ink is stable because the nozzle is less likely to be affected by the ink ejection from the driven, adjacent ink. Accordingly, the ink is ejected from the nozzle at a faster speed, so that more satellites are produced. Consequently, the amount of mist adhering to the ejection faces is probably increased.

By taking such characteristics into consideration, the printing apparatus of this fourth embodiment sets the poster/photo mode and the line-image mode as follows. In the poster/photo mode, 'the block driving order A' is adopted, and the multi-pass printing is performed with a larger number of passes in order to obscure the dot misalignment due to the ejection-timing differences. In the line-image mode, the multi-pass printing is performed with a smaller number of passes (the printing may be performed even with a single pass), and 'the block driving order B' is adopted, because the dots landed at misaligned positions due to the ejection-timing differences are less noticeable if 'the block driving order B' is adopted.

The number of preliminary ejections after the wiping in this fourth embodiment is calculated by taking account of the conditions examined in the third embodiment and the difference in the amount of mist adherence caused by the difference in the block driving order. Specifically, the number of preliminary ejections after the wiping in this fourth embodiment is calculated by the following formula. Note that examples of coefficients determined in accordance with the block driving order are shown in FIG. 9C.

(The number of preliminary ejections after the wiping)=(The number of preliminary ejections shown in FIG. 7B)×(A coefficient determined in accordance with the distance between the printing heads and the printing medium)×(A coefficient determined in accordance with the environment in which the printing apparatus is used)×(A coefficient determined in accordance with the block driving order)

As has been described thus far, in the fourth embodiment, the number of preliminary ejections after the wiping is regulated by taking account also of the possibility that the mist is made to adhere to the printing heads by the following, additional factors. Specifically, such additional factors that are taken into consideration include 'the distance between the printing heads and the printing medium' and 'the environment in which the printing apparatus is used (e.g., humidity, in particular).' In addition, another additional factor is the 'block driving order'. Accordingly, similar effects to those obtainable by the first to the third embodiments can be obtained in this fourth embodiment. In addition, a still larger effect of reducing the amount of inks wastefully consumed for the preliminary ejection can be obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-133355, filed Jun. 2, 2009, which is hereby incorporated by reference herein in its entirety.

What is claimed is:

1. An inkjet printing apparatus comprising:

a printing head that includes an ejection face in which at least one ejection opening configured to eject ink is formed;

a wiper configured to perform a wiping operation to wipe the ejection face;

a count unit configured to count an amount of printing from a last wiping operation to a present wiping operation; and a preliminary ejection unit configured to preliminarily eject an amount of ink from the printing head after the present wiping operation, the amount of ink being determined based on the amount of printing counted by the count unit.

2. An inkjet printing apparatus as claimed in claim 1, wherein the preliminary ejection unit is further configured to determine the amount of ink to be preliminarily ejected such that a first ejection amount is preliminarily ejected from the printing head when the amount of printing is a first printing amount, and a second ejection amount, greater than the first ejection amount, is preliminarily ejected from the printing head when the amount of printing is a second printing amount, greater than the first printing amount.

3. An inkjet printing apparatus as claimed in claim 1, wherein the amount of printing that occurs between the last wiping operation and the present wiping operation is determined based on a number of sheets which have been printed.

4. An inkjet printing apparatus as claimed in claim 1, wherein the amount of printing that occurs between the last wiping operation and the present wiping operation is determined based on a number of ink ejections corresponding to printing from the at least one ejection opening.

5. An inkjet printing apparatus as claimed in claim 4, wherein the printing head includes a plurality of ejection openings, and the preliminary ejection unit determines the amount of ink which is preliminarily ejected during the preliminary ejection from the plurality of ejection openings based on a number of ink ejections corresponding to printing from the plurality of ejection openings between the last wiping operation and the present wiping operation.

6. An inkjet printing apparatus as claimed in claim 4, wherein the printing head includes a plurality of ejection openings, and the preliminary ejection unit determines for each of the plurality of the ejection openings an amount of ink to be preliminarily ejected during the preliminary ejection based on a number of ink ejections corresponding to printing from the ejection opening between the last wiping operation and the present wiping operation.

7. An inkjet printing apparatus as claimed in claim 1, further comprising a support member configured to support a printing medium at a position in opposition to the ejection face, wherein the preliminary ejection unit is further configured to determine the amount of ink to be preliminarily ejected based on at least one of a distance from the ejection face to the printing medium and an environment condition.

8. An inkjet printing apparatus as claimed in claim 7, wherein the preliminary ejection unit increases the amount of ink to be preliminarily ejected in proportion to an increase in the distance from the ejection face to the printing medium.

9. An inkjet printing apparatus as claimed in claim 7, wherein the environment condition is humidity, and the preliminary ejection unit increases the amount of ink to be preliminarily ejected in proportion to a decrease in the humidity.

10. An inkjet printing apparatus as claimed in claim 1, further comprising a driving unit, wherein the printing head further comprises a plurality of ejection openings, and the driving unit divides the plurality of the ejection openings into a plurality of blocks, and performs ink ejection from the plurality of blocks consecutively, one block after another, in a predetermined order, and the preliminary ejection unit is further configured to determine the amount of ink to be preliminarily ejected in accordance with the predetermined order of driving the plurality of blocks.

11. An inkjet printing apparatus as claimed in claim 1, wherein the printing head adjusts an amount of ink ejected during the preliminary ejection, in accordance with the amount of ink to be preliminary ejected that is determined by the preliminary ejection unit, by changing a number of ink ejections in the preliminary ejection.

12. An inkjet printing apparatus according to claim 1, wherein the present wiping operation is a next sequential wiping operation after the last wiping operation.

13. An inkjet printing apparatus according to claim 1, wherein a count value of the count unit is configured to be reset after the wiping operation.

14. A method of controlling an inkjet printing apparatus to perform printing using a printing head that includes an ejection face in which at least one ejection opening to eject ink is formed, the method comprising:

performing a wiping operation to wipe the ejection face;

counting an amount of printing from a last wiping operation to a present wiping operation; and performing a preliminary ejection of an amount of ink from the printing head after the present wiping operation, the amount of ink being determined based on the amount of printing counted.

15. A method of controlling an inkjet printing apparatus as claimed in claim 14, wherein the amount of ink which is preliminarily ejected increases in proportion to an increase in the amount of printing that occurs between the last wiping operation and the present wiping operation.

16. A method of controlling an inkjet printing apparatus as claimed in claim 14, wherein the present wiping operation is a next sequential wiping operation after the last wiping operation.

17. A method of controlling an inkjet printing apparatus as claimed in claim 14, wherein a count value in the counting is configured to be reset after the wiping operation.

18. A method of controlling an inkjet printing apparatus as claimed in claim 14, wherein a first ejection amount of ink is preliminary ejected from the printing head when the amount of printing is a first printing amount, and a second ejection amount, greater than the first ejection amount, is preliminary ejected from the printing head when the amount of printing is a second printing amount, greater than the first printing amount.

* * * * *